US007036429B2

(12) United States Patent
Knauer et al.

(10) Patent No.: US 7,036,429 B2
(45) Date of Patent: May 2, 2006

(54) RUBBER BLANKET CYLINDER SLEEVE FOR WEB FED ROTARY PRINTING MACHINES

(75) Inventors: Peter Knauer, Münster/Lech (DE); Eduard Hoffmann, Bobingen (DE); Paul Steidle, Groβaitingen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/760,882

(22) Filed: Jan. 20, 2004

(65) Prior Publication Data

US 2004/0144276 A1 Jul. 29, 2004

Related U.S. Application Data

(63) Continuation-in-part of application No. 09/692,558, filed on Oct. 19, 2000, now abandoned.

(30) Foreign Application Priority Data

Oct. 20, 1999 (DE) ..... 199 50 643

(51) Int. Cl.
*B41N 10/04* (2006.01)

(52) U.S. Cl. ..... 101/376; 101/375; 101/216; 492/53; 492/56; 428/909

(58) Field of Classification Search ..... 101/216, 101/217, 375, 376, 368, 401.1; 492/53, 56; 428/909, 304; 156/86, 161
See application file for complete search history.

(56) References Cited

U.S. PATENT DOCUMENTS

| | | | | |
|---|---|---|---|---|
| 1,471,895 | A | 10/1923 | Huebner | |
| 4,125,073 | A | 11/1978 | Bain | |
| 4,466,349 | A | 8/1984 | Bartlett | |
| 4,981,750 | A * | 1/1991 | Murphy et al. | 428/220 |
| 5,304,267 | A | 4/1994 | Vrotacoe et al. | |
| 5,323,702 | A | 6/1994 | Vrotacoe et al. | |
| 5,351,615 | A | 10/1994 | Köbler et al. | |
| 5,429,048 | A | 7/1995 | Gaffney et al. | |
| 5,440,981 | A | 8/1995 | Vrotacoe et al. | |

(Continued)

FOREIGN PATENT DOCUMENTS

| | | |
|---|---|---|
| DE | G 85 07 422.5 | 9/1986 |

(Continued)

*Primary Examiner*—Andrew H. Hirshfeld
*Assistant Examiner*—Kevin D. Williams
(74) *Attorney, Agent, or Firm*—Cohen, Pontani, Lieberman & Pavane

(57) ABSTRACT

A transfer cylinder sleeve is provided for an offset printing machine including an inner carrier layer, a compressible layer and a covering layer, where at least one of the layers has a joint or a gap and provided that when a joint or a gap is used in the covering layer, then the transfer cylinder sleeve is applied to a transfer cylinder in register so that the joint in the covering layer rests opposite a tension channel of a plate cylinder during rolling contact of the transfer cylinder with the plate cylinder. Optionally, a non-stretchable layer is provided between the compressible layer and the covering layer, or alternatively, a non-stretchable material is provided in the compressible layer itself.

10 Claims, 1 Drawing Sheet

U.S. PATENT DOCUMENTS 5,553,541 A * 9/1996 Vrotacoe et al. ..... 101/217
5,768,990 A * 6/1998 Vrotacoe et al. ..... 101/217
5,787,812 A * 8/1998 Shoji ..... 101/415.1
5,832,824 A * 11/1998 Okubo et al. ..... 101/217
5,934,192 A * 8/1999 Ogita et al. ..... 101/217
6,074,735 A * 6/2000 Ogita et al. ..... 428/222
6,148,725 A 11/2000 Knauer et al.
6,182,568 B1 * 2/2001 Ogita et al. ..... 101/376
6,205,920 B1 * 3/2001 Dzierzynski et al. ..... 101/217
6,289,809 B1 * 9/2001 Sonobe ..... 101/401.1
6,386,100 B1 * 5/2002 Gaffney et al. ..... 101/142

FOREIGN PATENT DOCUMENTS

EP 0 435 027 A2 7/1991
JP 6-48063 2/1994

* cited by examiner

RUBBER BLANKET CYLINDER SLEEVE FOR WEB FED ROTARY PRINTING MACHINES

CROSS-REFERENCE TO RELATED APPLICATIONS

This application is a Continuation of U.S. application Ser. No. 09/692,558, filed Oct. 19, 2000, now abandoned which claims priority from an application no. 199 50 643.4, filed in Germany on Oct. 20, 1999.

BACKGROUND OF THE INVENTION

1. Field of the Invention

The present invention relates to a transfer cylinder sleeve including an inner carrier layer, a compressible layer, a non-stretchable layer and a covering layer. The present invention is suitable for use in an offset printing machine.

2. Description of the Related Art

German reference DE 196 28 555 A1 discloses a similar device. In addition, sleeves of this type are known for example, from U.S. Pat. Nos. 5,429,048, 5,323,702, 5,440,981 and 5,304,267. One disadvantage of these known rubber blanket cylinder sleeves (i.e., transfer cylinder sleeves) is that the middle and lower layers of these sleeves have to be at least partially continuous. This has a particularly adverse effect on production costs.

It is also known from U.S. Pat. No. 5,351,615 to apply a rubber blanket to a carrier plate, for example by adhesive bonding. This arrangement is subsequently shaped into a rubber-blanket cylinder sleeve, and both the mutually confronting ends of the carrier plate and those of the rubber blanket or rubber coating are connected to one another, for example by welding or adhesive bonding. Although this arrangement no longer has any gap, a connecting scam or joint remains on the surface.

SUMMARY OF THE INVENTION

The object of the present invention is to produce a generic rubber blanket cylinder sleeve, in particular for web-fed rotary offset printing machines, that is less expensive than known sleeves and to provide an approximately equal or improved printing quality and behavior than is currently available.

The present invention provides a transfer cylinder sleeve for use in an offset printing machine including an inner carrier layer, a compressible layer and a covering layer, where at least one of the layers has a joint or a gap. When a joint or a gap is used in the covering layer, the transfer cylinder sleeve is applied to a transfer cylinder in-register, so that the joint in the covering layer rests opposite a tension channel of a plate cylinder during rolling contact of the transfer cylinder with the plate cylinder. Optionally, a non-stretchable layer is provided between the compressible layer and the covering layer, or alternatively, a non-stretchable material is provided in the compressible layer itself. The present invention is particularly suited for use on a rubber-blanket cylinder in a web fed rotary offset printing machine.

As is known from the prior art, the basic design of rubber blanket cylinder sleeves of this type consist essentially of an inner, preferably metallic, carrier sleeve. Alternatively, a glass fiber reinforced sleeve (i.e., glass fiber reinforced plastic) may be used instead of the inner metal sleeve. The thickness of these sleeves is dimensioned in such a way that they can be expanded slightly by air when pushed onto the transfer cylinder (i.e., also referred to as a rubber-blanket cylinder) of printing machines operating by indirect printing methods. This is advantageous, since, as shown in U.S. Pat. No. 5,429,048 it is possible to push a sleeve of this type through the side wall of a printing machine onto die transfer cylinder which has previously been exposed on one side. At the same time, the transfer cylinder sleeve is precisely expanded by means of compressed air with the aid of orifices provided in the transfer cylinder. As a result, it is possible to apply the sleeve in a simple way, after which the transfer cylinder sleeve assumes a firm fit on the transfer cylinder once the compressed air is turned off.

At least one further compressible layer (i.e., having air spaces or pockets) is applied, directly or indirectly, on the inner carrier sleeve. At least one covering layer, which may consist, for example, of an elastomeric material, is provided over this further compressible layer. By means of this covering layer material, the image to be printed is taken from a form cylinder or from a printing form (i.e., an offset printing plate or a sleeve shaped offset printing form) and is transferred onto a print carrier.

Preferably, between the compressible layer (i.e., an elastomer with air spaces) and the covering layer, is a further non-stretchable layer. For example, a hard elastomeric material may be used or short fibers (i.e., threads) which can be embedded in the hard elastomeric material. Alternatively, a non-stretchable layer or non-stretchable particles, such as threads or pieces of threads, may also be introduced directly in the above-mentioned compressible layer.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
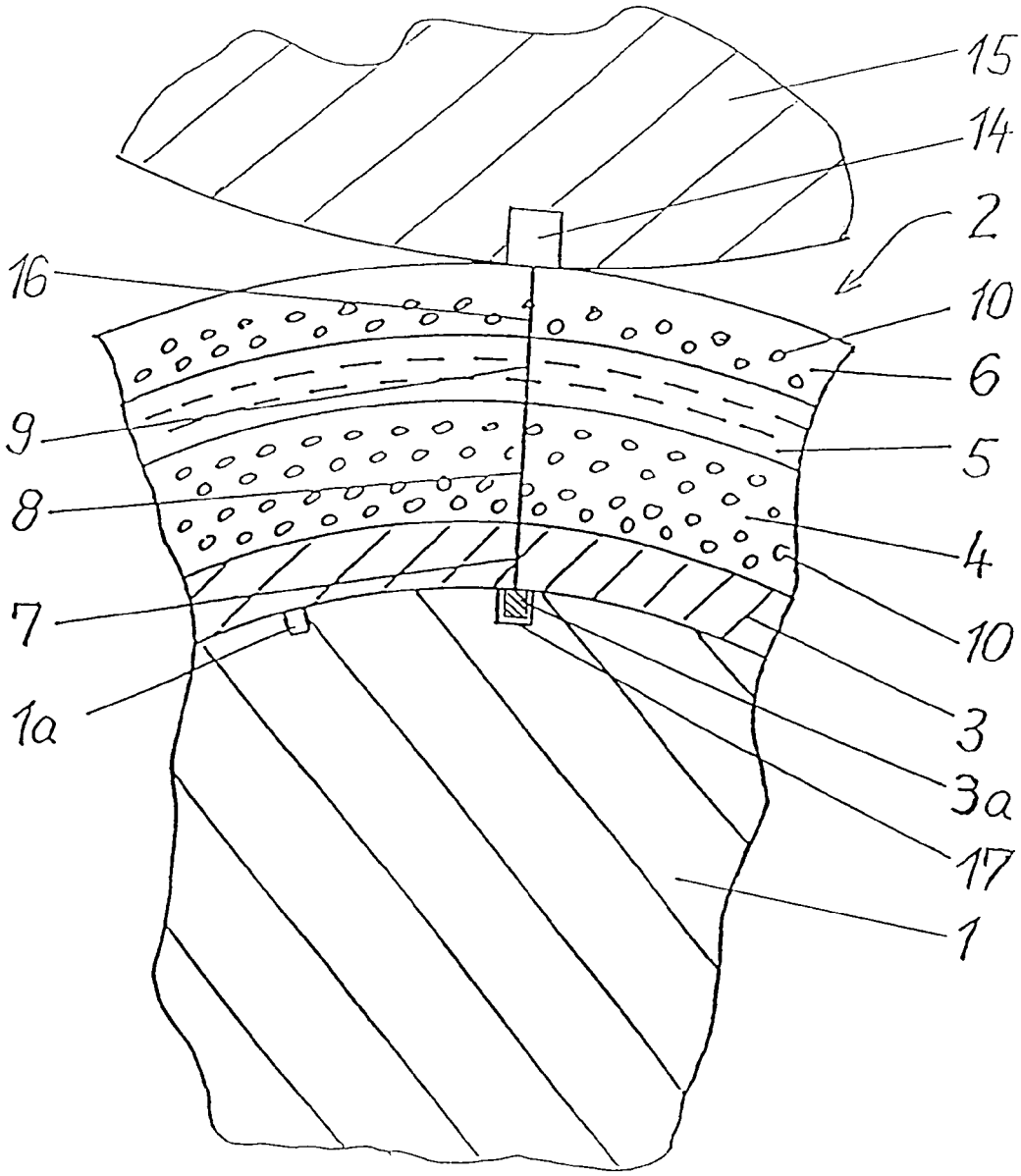
FIG. 1 is a schematic partial and cross-sectional view of a transfer cylinder sleeve according to the present invention.

FIG. 1 illustrates a cross-sectional view of an embodiment of the present invention. The transfer cylinder 1 (i.e., rubber-blanket cylinder) includes orifices or nozzles 1*a* provided on its surface. The transfer cylinder sleeve 2 (i.e., rubber blanket sleeve) has a metal carrier sleeve 3 which is expandable (preferably by means of air) and on which a compressible layer 4 is vulcanized or glued. A layer composed of a non-stretchable material 5, preferably a hard elastomer layer with short fibers, is provided on the compressible layer 4. A covering layer 6 is provided on the non-stretchable layer 5. The covering layer 6 is composed, for example, of an elastic material. This transfer cylinder sleeve 2 can be used to perform offset printing.

In the present invention, the carrier sleeve 3 used has a joint 7 and is preferably a metal sleeve, i.e., made of steel, which can be expanded by means of air. The joint 7 may, for example, be a weld seam. The joint 7 may be formed by making the metallic sleeve 3 out of a plate and then welding the ends together to form the joint 7.

The carrier sleeve 3 may also be produced so as to be free of joints and of gaps in which case joint 7 is absent. In a metallic version of this kind, production by electroplating is recommended. Even non-metallic carrier sleeves 3 can be produced advantageously so as to be free of joints and gaps.

The term "joint" is meant to indicate that a sleeve-shaped layer, cylindrical rubber or plastic layer, or a sleeve-shaped or cylindrical metallic or non-metallic carrier layer is not continuous, i.e., is not seam-free in the circumferential direction, that there is a seam or a joint in the longitudinal or axial direction. The joint may have layers abutting one another. It may also constitute a gap between the ends of a layer. Advantageously, the gap is closed by means of an adhesive or vulcanizable material.

The compressible layer 4 similarly has a joint 8 produced by gluing the compressible layer 4 in the form of a rubber blanket onto the metal sleeve 3. The joint 8 is formed by the ends of the rubber layer 4. In the same way, if a non-stretchable layer 5 is used on the compressible layer 4, according to the present invention, the non-stretchable layer 5 may likewise have a joint 9 which may be formed as described above. Moreover, according to a preferred embodiment, a covering layer 6 without a joint is applied to a layered sleeve of this type, meaning a carrier sleeve 3, preferably made of metal, with a joint 7 has at least one applied compressible layer 4 with a joint 8.

It is also possible for the covering layer 6 to have air spaces 10 in the same way as the compressible layer 4. In this way, the covering layer 6 also has some compressibility. This is advantageous, compared with the prior art, and is expected to lead to better printing results or printing behavior and better web guidance.

In a particularly advantageous embodiment, the sleeve according to the present invention may also be produced using a welded metal sleeve 3 made of either steel, aluminum or a chemical fiber reinforced plastic sleeve with a joint 7, on which a conventional offset rubber blanket, i.e., with a compressible layer, is applied. The compressible layer 4 may be glued or vulcanized onto the rubber blanket. The covering layer 6 of the conventional rubber blanket is then removed, i.e., ground away. In place of the covering layer 6, a continuous, i.e., joint-flee covering layer 6 is applied, for example by vulcanization. As compared with known sleeves, production of this kind and a sleeve composition of this type are substantially more cost-effective and have a number of advantages. In this case, the joints 8, 9 are located one above the other, since they constitute the ends of the conventional rubber blanket which has been glued to the carrier sleeve 3. The joints 8, 9 may advantageously be arranged directly above the joint 7, but this is not necessarily required. In the application of further finite individual layers, i.e., at least a compressible layer 4 and a covering layer 6 and also, if appropriate, a further non-stretchable layer 5, the individual joints 7, 8, 9 may also be located circumferentially at other points, i.e., they do not have to be located one above die other. If a further non-stretchable layer 5 is used, short non-stretchable pieces, such as threads, may be used, as illustrated in FIG. 1.

The sleeve 2 according to the present invention affords a multiplicity of possibilities for use which are not restricted solely to use in web-fed rotary offset printing machines. Thus, this sleeve 2 may also be used, for example, in other indirect printing methods, such as indirect intaglio printing or may be used as a roller.

It is advantageous to apply the sleeve 2 in register. This may be performed, for example, by the sleeve 2 being pushed onto the cylinder in a predetermined circumferential position. For example, a marking may be present at one sleeve end and at one transfer cylinder end. The markings, made congruent or even with one another allow registry, i.e., the sleeve 2 can be pushed onto the transfer cylinder 1 in such a way that a tension channel 14 of a plate cylinder 15 is located opposite die joints 7, 8, 9 or gaps in the region where these cylinders roll on one another, as shown in FIG. 1. Regarding the registry described, even the covering layer 6 may have a joint or gap, as indicated at 16. If the gap 16 or the joints or gaps are relatively large, they may be closed by means of suitable material, for example an adhesive or vulcanizable material.

An appropriate firm fit of the sleeve 2, for example of the metal layer 3 on the transfer cylinder 1 makes it possible to ensure that the sleeve 2 remains fixed in the register position during operation. Alternatively, it is also possible to ensure registry by means of a positive connection, for example by means of a strip 3*a* which is fastened to the inner wall of the metal sleeve 3 and can be pushed into an axially running slot 17 of the transfer cylinder 1 during mounting of the sleeve 2.

In FIG. 1, all the layers 3 to 6 are shown with a joint 7, 8, 9, 16 or with a gap. A joint or a gap 16 may also be present only in some layers or in only a single layer, for example in the covering layer 6. In this case, the joints 7 to 9 are absent. If a joint 16 or a gap is present in the outer covering layer 6, the rubber blanket cylinder sleeve 2 must be applied to the transfer cylinder 1 in-register, i.e., applied so that the joint or the gap 16 is located opposite the tension channel 14 of the plate cylinder 15 in the region where the plate cylinder and the transfer cylinder roll on one another.

In a further embodiment of the present invention, only the outer layer 6, i.e., the layer receiving the printing image, is elastic. In other words, it is preferred that only the lower-region or part is made, for example, with air spaces. Alternatively, if appropriate, the lower region is made with downwardly open air ducts. A layer formed in this way, in which non-stretchable materials, for example having threads or thread pieces may be arranged directly on a carrier sleeve.

It is also possible to produce the carrier layer 3 from a fiber reinforced hard rubber, with or without a seam or gap, with the layer being stretchable, for example, by means of compressed air. In a particularly advantageous embodiment, arranged above the carrier layer 3 is a compressible layer, then a semi-compressible layer, which may be fiber reinforced, and then a printing covering layer.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A transfer cylinder sleeve in an offset printing machine, the offset printing machine having a transfer cylinder and a plate cylinder, the plate cylinder having a tension channel, wherein the transfer cylinder sleeve comprises:

an inner carrier layer mountable onto the transfer cylinder, said carrier layer being expandable by compressed air;

a compressible layer mounted on said carrier layer, said compressible layer defining air spaces therein;

a cover layer being compressible and mounted on said compressible layer, said cover layer being less compressible than the compressible layer, one of said inner carrier layer, said compressible layer, and said cover layer comprising a joint or gap along a longitudinal length thereof; and a registration device arranged on an inner surface of said carrier layer engagable with the transfer cylinder, whereby said carrier layer is fixable to the transfer cylinder at a register position and said joint is alignable to roll on the tension channel of the plate cylinder.

2. The transfer sleeve according to claim 1, in combination with the transfer cylinder of the offset printing machine, wherein said transfer cylinder comprises means for receiving said registration device, wherein said registration device and said means for receiving form a positive connection, thereby fixing the transfer sleeve in the register position.

3. The transfer sleeve of claim 1, wherein said cover layer defines air spaces.

4. The transfer sleeve of claim 1, wherein said carrier layer is metal.

5. The transfer sleeve of claim 4, wherein said carrier layer has a weld seam joint, wherein each of said carrier layer, said compressible layer, and said cover layer defines a joint formed by mutually abutting ends of said carrier layer, said compressible layer, and said cover layer, respectively.

6. The transfer sleeve of claim 5, wherein each joint of said carrier layer, said compressible layer, and said cover layer is an adhesive joint.

7. The transfer sleeve of claim 1, further comprising a non-stretchable layer arranged between said compressible layer and said cover layer.

8. A transfer sleeve in an offset printing machine, the offset printing machine having a transfer cylinder and a plate cylinder, the plate cylinder having a tension channel, wherein the transfer cylinder sleeve comprises:

an inner carrier layer mountable onto the transfer cylinder, said carrier layer being expandable by compressed air;

a compressible layer mounted on said carrier layer, said compressible layer defining air spaces therein;

a cover layer being compressible and mounted on said compressible layer, one of said inner carrier layer, said compressible layer, and said cover layer comprising a joint or gap along a longitudinal length thereof, wherein said cover layer comprises only a single layer having a radially inner region and a radially outer region, wherein said radially inner region defines air spaces therein and said radially outer region comprises an elastic part without air spaces.

9. The transfer sleeve of claim 8, further comprising a registration device arranged on an inner surface of said carrier layer engagable with the transfer cylinder, whereby said carrier layer is fixable to the transfer cylinder at a register position and said joint is alignable to roll on the tension channel of the plate cylinder.

10. The transfer sleeve of claim 8, wherein said cover layer is less compressible than said compressible layer.

* * * * *